United States Patent [19]

Pfeiffer

[11] Patent Number: 4,781,248

[45] Date of Patent: Nov. 1, 1988

[54] PLATE HEAT EXCHANGER

[75] Inventor: Johann Pfeiffer, Bretten, Fed. Rep. of Germany

[73] Assignee: W. Schmidt GmbH & Co., K.G., Bretten, Fed. Rep. of Germany

[21] Appl. No.: 50,457

[22] Filed: May 18, 1987

[30] Foreign Application Priority Data

Jul. 3, 1986 [DE] Fed. Rep. of Germany ..... 3622316

[51] Int. Cl.[4] ..... F28F 3/08

[52] U.S. Cl. ..... 165/167; 165/166

[58] Field of Search ..... 165/167, 166

[56] References Cited

U.S. PATENT DOCUMENTS

| | | | |
|---|---|---|---|
| 3,807,496 | 4/1974 | Shadwark | 165/167 |
| 4,182,411 | 1/1980 | Sumitomo et al. | 165/167 |
| 4,630,674 | 12/1986 | Skoog | 165/167 X |

FOREIGN PATENT DOCUMENTS

| | | | |
|---|---|---|---|
| 2601231 | 7/1976 | Fed. Rep. of Germany | 165/167 |
| 2552335 | 6/1977 | Fed. Rep. of Germany | 165/167 |
| 1486919 | 9/1977 | United Kingdom | 165/167 |
| 2054817 | 7/1979 | United Kingdom | 165/167 |
| 2107845 | 5/1983 | United Kingdom | 165/167 |

OTHER PUBLICATIONS

"Plate Heat Exchanger" D. F. Clark *The Chemical Engineer*, May 1974, pp. 275–279, 285.

*Primary Examiner*—Ira S. Lazarus
*Assistant Examiner*—Peggy A. Neils
*Attorney, Agent, or Firm*—Edwin E. Greigg

[57] ABSTRACT

A heat exchanger comprising plates rotated by 180° relative to one another and fastened into a stack is disclosed, in which the interstices between plates are supplied with the media via inlet and outlet openings at the corners of the plates and abut one another via projections from their profile, the profile including a middle, rectangular heat exchange zone and two adjoining triangular heat exchange zones. The profile of the triangular zones is formed by sections adjoining one another and having opposite embossing directions to form adjoining peaks and valleys, such that the sections of one embossing direction of one triangular zone abut the sections of the other embossing direction of the adjoining plates that are rotated by 180° relative to the first, and between the rows of peaks and valleys are disposed flow channels connecting the plate openings with the rectangular heat exchange zone, the flow channels being adapted for communication with one another normal to the flow direction, by passage through the spacing of adjacent rays via channel segments.

13 Claims, 13 Drawing Sheets

FIG. 14
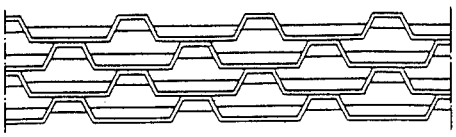
FIG. 15
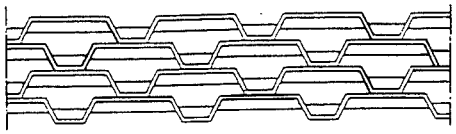
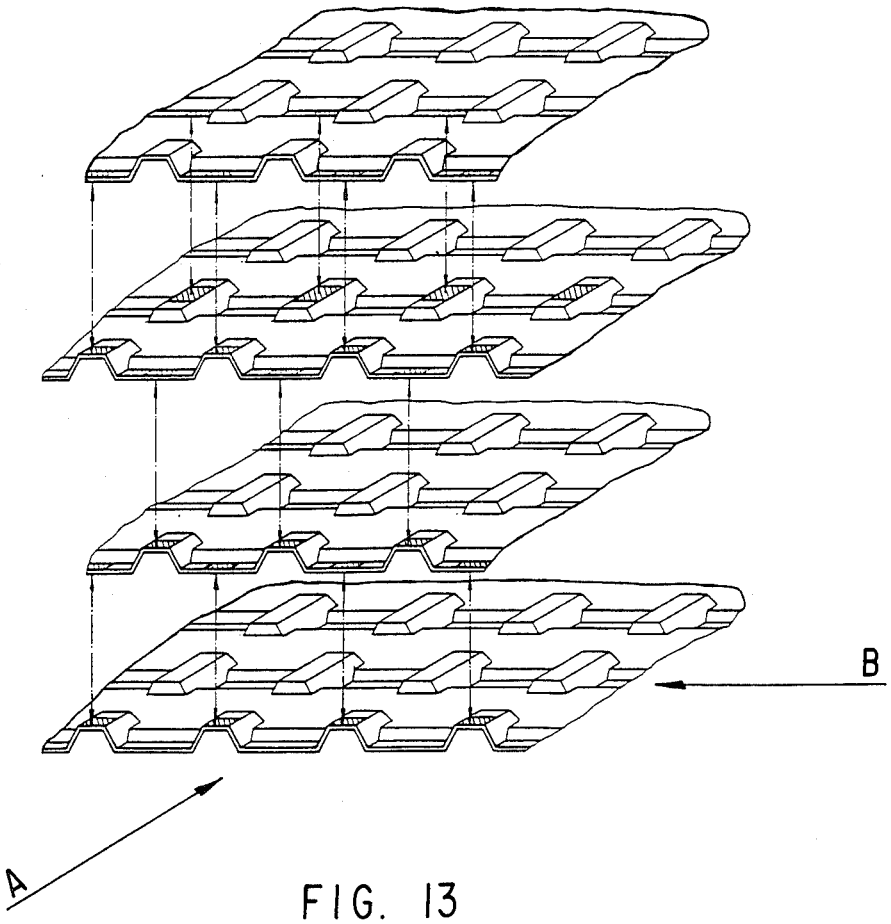
FIG. 13

PLATE HEAT EXCHANGER

FIELD OF THE INVENTION

The invention discloses improvements in plate-type heat exchangers.

BACKGROUND OF THE INVENTION

The present invention relates generally to a heat exchanger comprising substantially rectangular plates in alignment with one another and provided by embossing with a head-like profile of uniform total depth. The plates are alternatingly rotated by 180° relative to one another, with a peripheral gasket between them, and are fastened detachably into a stack with the facing profiles of adjacent plates resting on one another. The plates include portions in which are formed first and second flow spaces, encompassed by the peripheral gasket, for a first medium flowing in one direction and a second medium flowing in the opposite direction, respectively, the first and the second flow portions being disposed diagonally opposite one another and being guided substantially parallel to one another, and the flow spaces are supplied with the respective medium via inlet and outlet openings in alignment with one another and formed by holes disposed in the corner regions of the plates. The plates also have a middle, rectangular heat exchange zone and two triangular heat exchange zones adjoining the middle zone on opposite sides, and the triangular zones carry the flow cross section of the middle zone to that of the inlet and outlet opening. For this purpose, the profile of the triangular zones comprises substantially divergent ray-like passages originating at the respective opening and merging into a chevron-like array of flow passages having a common pitch defining a mutual spacing.

In known heat exchangers of this type, the relatively thin-walled plates, which are often also identical in shape to one another, are held together in a frame and fastened between thicker end plates into a stack; the end plates contain the connections for the media, which are guided along the plate stack via channels that are formed by the aforementioned openings in the plates, in combination with a suitable embodiment of the gaskets.

In the flow spaces between the plates, depending on the embodiment of the plate embossing, the flow is either diagonal or substantially parallel to the longitudinal direction of the plates, and correspondingly there are either diagonally opposed holes in the plates, or openings located to one side of the vertical center of the plates, that serve as inlet and outlet openings.

In the case of the above-mentioned triangular zones of the plates, the profile is embodied, in known instances, in the form of beads having a mutual spacing from one another, which originating at the plate opening associated with them extend substantially in ray-like form and as a rule form an angle on the order of 25° to 40° with the vertical line of symmetry of the plates. Since adjoining plates are rotated by 180° relative to one another, the profiles of the triangular zones of adjoining plates intersect, as a result of which the plates here abut one another at the intersecting points.

The known embodiment, in this form, of the triangular zones of the plates has the disadvantage, however, that it results in a relatively high pressure loss, and with that loss, the most uniform possible distribution of the respective medium over the entire triangular surface area is virtually unattainable or is at least much more difficult, because in terms of the flow paths formed between the individual beads, an exchange of pressure and media is virtually impossible on the way between the associated plate opening and the rectangular zone of the heat exchange surface. As a result, the distribution of media over the triangular zones is so impaired that these zones can participate in the task of heat exchange only to a secondary extent.

OBJECT AND SUMMARY OF THE INVENTION

It is therefore the principal object of the invention to modify a heat exchanger of the above generic type, in terms of the embodiment of the plates, in such a way that the pressure loss dictated by the triangular zones is reduced and a substantially better media distribution over the triangular zones is attained, so that to the greatest possible extent these zones are also included in the surface area participating in the heat exchange.

According to the invention this object is attained in that the rays of one triangular zone comprise a profile having regularly interrupted flow sections, each flow section having the same pitch as the ray spacing and adjoining one another in the direction of the rays, the interrupted sections being embossed in alternating relation, and in opposite directions, to the ray passages.

The embossing of the triangular zone is done so that peaks are formed projected upwardly and valleys are formed projected downwardly, in alternating relation, with half of the embossing depth originating at the base material of the plate, wherein the spacings between the rays, by raising the base material, form the faces of plateaus at the level of half the total depth of the plate embossing. The valleys are formed between adjacent peaks at the same depth as the height of the peaks, i.e. half the total depth of embossing the base plate level.

Similarly, the rays of the other triangular zone, along the extent where they are covered by the rays, but rotated by 180°, of the first triangular zone of an adjoining plate, have a profile also having regularly interrupted sections corresponding to that of the first triangular zone but embossed in the opposite direction, wherein the spacings between the sections of this profile also, by raising the base material, form peaks with intermediate valleys therebetween at the level of half the total depth of the plate embossing.

Plate embossing is conventionally done by embossing the profile of the panel-like base material, which is placed in a press, outward in only one direction, beginning at the base material. In the invention, contrarily, the embossing operation for the triangular zones now shifts the plateau of the base material to half the height or depth of the total plate profile, and beginning there the valley sections are formed in opposite directions, which in view of the special materials typically used in the present instance already has the considerable advantage of reducing the embossing deformation by half, and moreover improves the embossing capability for more complicated shapes as well.

Additionally, however, crosswise channels, with respect to the above-mentioned direction of the rays, are formed, and in terms of their cross section these channels are in no way inferior to the channels that are the point of departure for the present invention, so that there can also in fact be an unhindered media distribution over the triangular zones crosswise to the main flow direction, with the advantage, first, that the pressure resistance of the triangular zones is considerably reduced, and second, that these triangular zones are fully included in the heat exchanging surface area.

A further resultant advantage is that in terms of the embossing pattern, it no longer matters whether the flow through the heat exchanging space formed between the adjoining plates is through inlet and outlet openings that are diagonally located, or through such openings that are located to one side of the vertical center of the plate.

Finally, the pressure resistance of the triangular zones proves to e improved by the embossing of these zones according to the invention.

Precisely in this last-mentioned context, it has proven to be suitable for the sections of the profile, at right angles to the plate surface, to have a sinusoidal cross section or a substantially rectangular apical surface. In this connection, it is also advantageous that the sections resting on one another of adjoining plates form an angle with one another with respect to the direction of their largest cross section. This prevents adjoining plates from slipping away from one another under the pressure with which the stack of plates is fastened together. For the aforementioned angle formed between sections in contact with one another, an order of magnitude of 90° is desirable.

Beginning with the concept of the invention on which the profiling of the triangular zones is based, it has been found in a further development of the invention to be advantageous to provide such a profile for the rectangular zone of the heat exchanger surface as well.

To this end, the middle, rectangular zone of the plates, parallel to the flow direction of the media, can have a profile embodied by rows of adjoining sections having opposite embossing directions with one-half the embossing depth originating at the base material of the plates, the rows having a common distance spacing, crosswise to the longitudinal extent. The spacings, by raising the base material, can be arranged to form plateaus at the level of half the total depth of the plate embossing, and the sections of oppositely directed embossing can be staggered in alternation with respect to the plateaus in the longitudinal direction of the rows. Moreover the sections of one embossing direction of one plate meet sections of the opposite embossing direction of the adjoining plates, rotated by 180°, when the stack of plates is arranged.

In a second embodiment along these lines, the middle, rectangular zone of the plates can have, crosswise to the flow direction of the media, a profile embodied by identical rows of adjoining sections having oppositely-disposed embossings (a peak between adjacent valleys) with half the embossing depth originating at the base material of the plates, the rows again having a common distance spacing, crosswise to the longitudinal extent. The spacings, again by raising the base material, are arranged to form the plateaus at the level of half the total depth of the plate embossing, while the sections of oppositely-directed embossing can be staggered in alternation with respect to one another in the longitudinal direction of the rows in such a manner that sections of one embossing direction of one plate meet sections of opposite embossing direction of the adjoining plates, which are rotated by 180°, when the stack of plates is arranged.

Finally, there is a third embodiment in which the middle, rectangular zone of the plates is divided into two halves each half adjoining a respective triangular zone, the halves having a profile that continues the profile of the triangular zone bordering them, and between the halves a transitional cross section, extending crosswise to the flow direction of the media over the entire flow cross section of the plates, is embodied that is left unchanged, i.e., without deformation of the original material comprising the plates.

Especially for media laden with solids, all these three options offer advantageous flow conditions, and depending upon the specifics of an individual case preference may be given to one or the other option, for example, whether the kind of solid entrained in the medium has to be taken particularly into account or not, or whether to promote particularly good heat exchange a maximum extent of turbulence in the medium should be sought. All these options also have the advantage that the flow spaces on both sides of the plates are embodied identically, so that without making special provisions, it is also possible for two media laden with solids to be brought into a heat-exchanging relationship with one another.

Finally, in all the above-mentioned cases, it may be provided that the plates, between the triangular zones and the middle, rectangular zones, have a flat transitional cross section, extending over the entire flow cross section of the medium, that is left unchanged, i.e., without deformation of the original material comprising the plates. This transitional cross section would act in the manner of a tie bar crosswise to the longitudinal direction of the plates, with respect to the pressure with which the stack of plates is fastened, and thereby promote the shape stability of the plates.

The invention will he better understood and further objects and advantages thereof will become more apparent from the ensuing detailed description of preferred embodiments, taken in conjunction with the drawings.

BRIEF DESCRIPTION OF THE DRAWINGS

FIG. 13 is an exploded view of a series of stacked heat exchanger plates in accordance with the preferred embodiment of the invention.

FIG. 14 is a sectional view of a stack of heat exchanger plates taken in the direction of arrow A of FIG. 13; and FIG. 15 is a cross-sectional view of a stack of heat exchanger plates taken in the direction of arrow B of FIG. 13.

DESCRIPTION OF THE PREFERRED EMBODIMENTS

Figure 1:
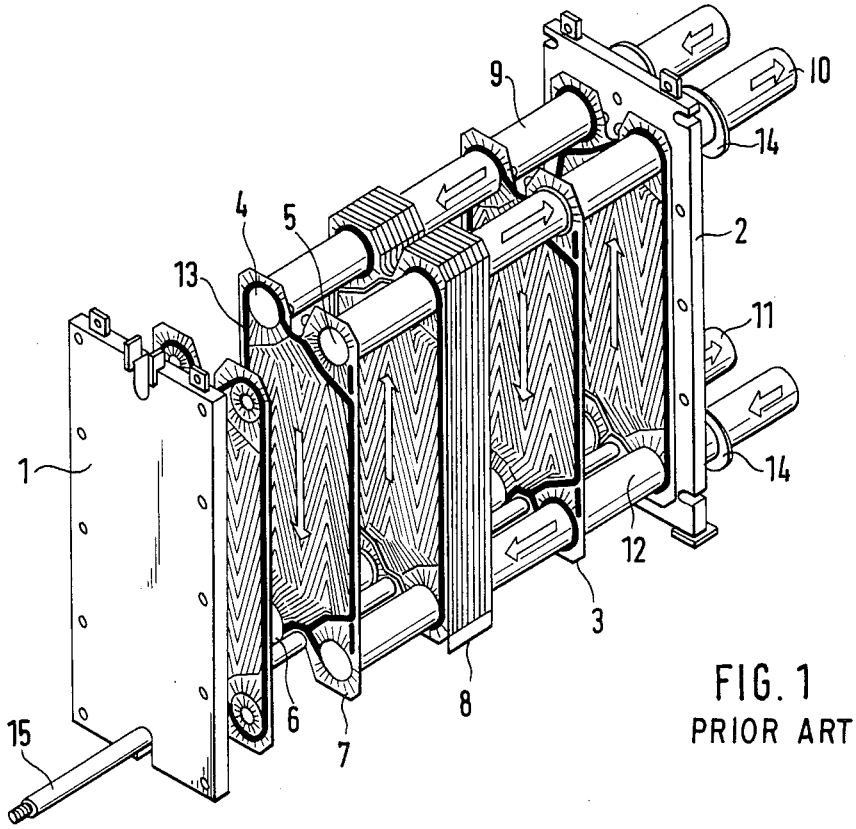
FIG. 1 PRIOR ART
FIG. 1 is an exploded perspective view of a known heat exchanger.

FIG. 1 is an exploded view of a heat exchanger, in which a packet of rectangular heat exchanger plates 3, identical to one another and alternatingly rotated by 180° relative to one another, is fastened between end plates 1, 2. In the corner zones of the plates 3, means defining openings 4–7 are formed, which when the packet is fastened together, as shown at 8, form continuous channels 9–12, by way of which two media intended for mutual heat exchange are supplied to the spaces formed between the plates.

The spaces for the medium that are formed between the plates are closed off toward the outside by peripheral gaskets 13 fastened between adjoining plates; in the present case the gaskets are embodied such that they connect the spaces having the openings 4, 6 as inlet and outlet openings. The openings 5 and 7 then serve as a means for one medium to bypass the space between plates that is supplied with the other medium.

The supports 14 attached to the outside on the end plate 2 are used for connecting the inlet and outlet line for the media. The heat exchanger plates 3 are also guided to prevent displacement between the end plates 1 and 2 by rods, of which only the lower rod 15 is shown, that engage recesses in the plates.

Figure 2:
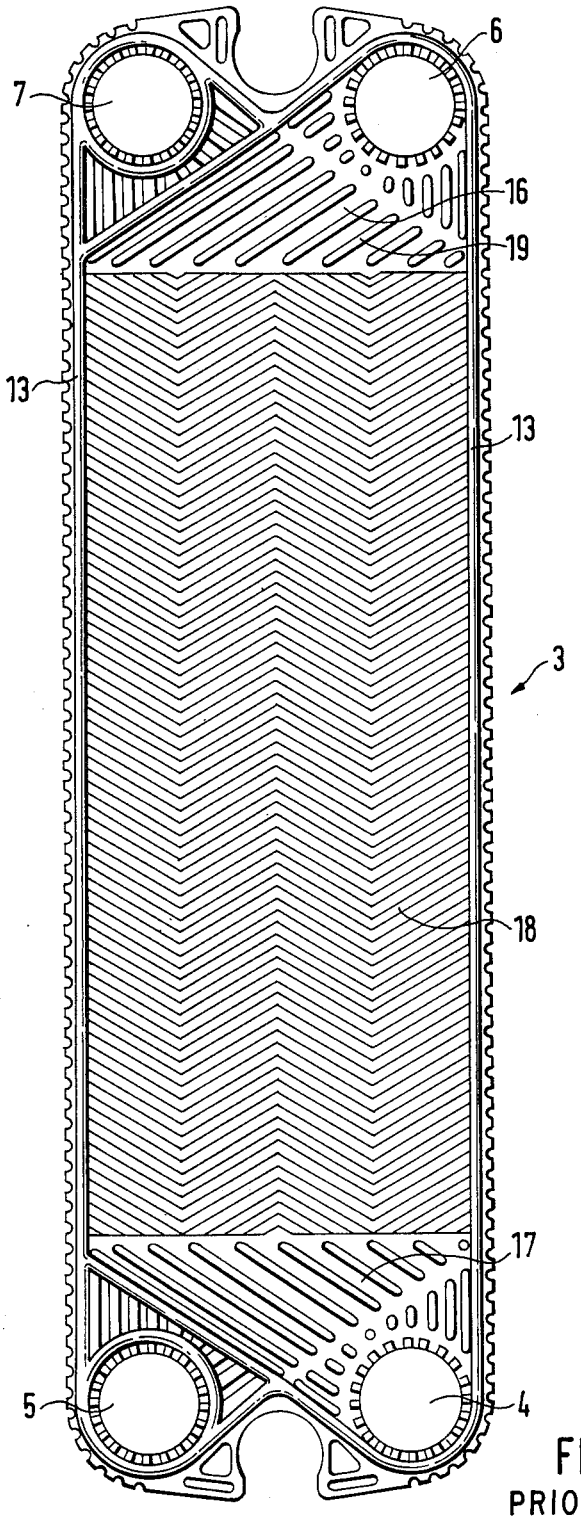
FIG. 2 PRIOR ART
FIG. 2 shows a plan view of the heat exchanger plate of FIG. 1.
Figure 3:
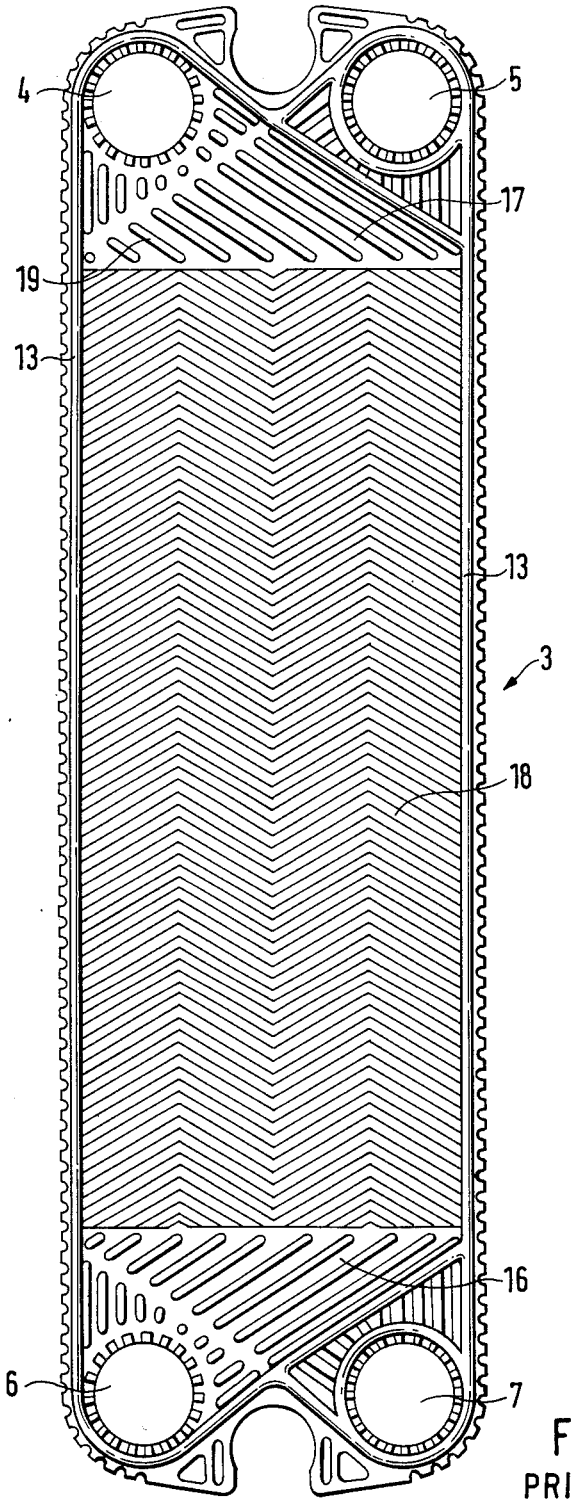
FIG. 3 PRIOR ART
FIG. 3 shows a plan view of the heat exchange plate of FIG. 2 rotated by 180° relative to one another.

FIGS. 2 and 3 show a plate 3 respectively in one form and in the form rotated by 180° thereto, in the manner in which they come to be located alternatingly in succession in the stack of plates. FIG. 2 more clearly shows that the peripheral gasket 13 provides communication between the particular space between plates that it encloses and the openings 4 and 6, while the openings 5 and 7 that serve merely to carry the other medium onward to the next successive plate are sealed off with respect to this particular space between plates.

Across the flow spaces thus formed between the plates and defined by the peripheral gaskets, the plates, which are identical to one another, have a corrugated profile produced by embossing, dual columns of chevron-like grooves therein oriented in one direction on an intermediate rectangular zone 18, which zone separates the ends of the plates into two triangular zones 16 and 17. The profile of the triangular zones 16 and 17, which is formed by ray-like beads 19, serves to transfer the media between the cross section of the associated opening 4 or 6 and the cross section of the rectangular heat exchange zone 18.

As shown, the aforementioned profiles intersect when plates of the type shown in FIGS. 2 and 3 are placed alternatingly on top of one another, so that the adjoining plates rest on one another at the points of intersection and in this manner are braced against one another.

To this point and as described in conjunction with FIGS. 1–3, a heat exchanger, its function, and the plates used in it are known in the prior art; in terms of what follows, it should merely be pointed out that in the known case, when the plates are produced the profile in its entire height, beginning at the panel-like material placed in a press, is embossed by shaping same outwardly in only one direction, so that for instance referring to FIGS. 2 and 3 the flat surfaces remaining between the beads 19 are equivalent to the base material left unworked, and thus from the plane of the drawing the profile of the plates 3 offstands in the direction of the observer.

Figure 4:
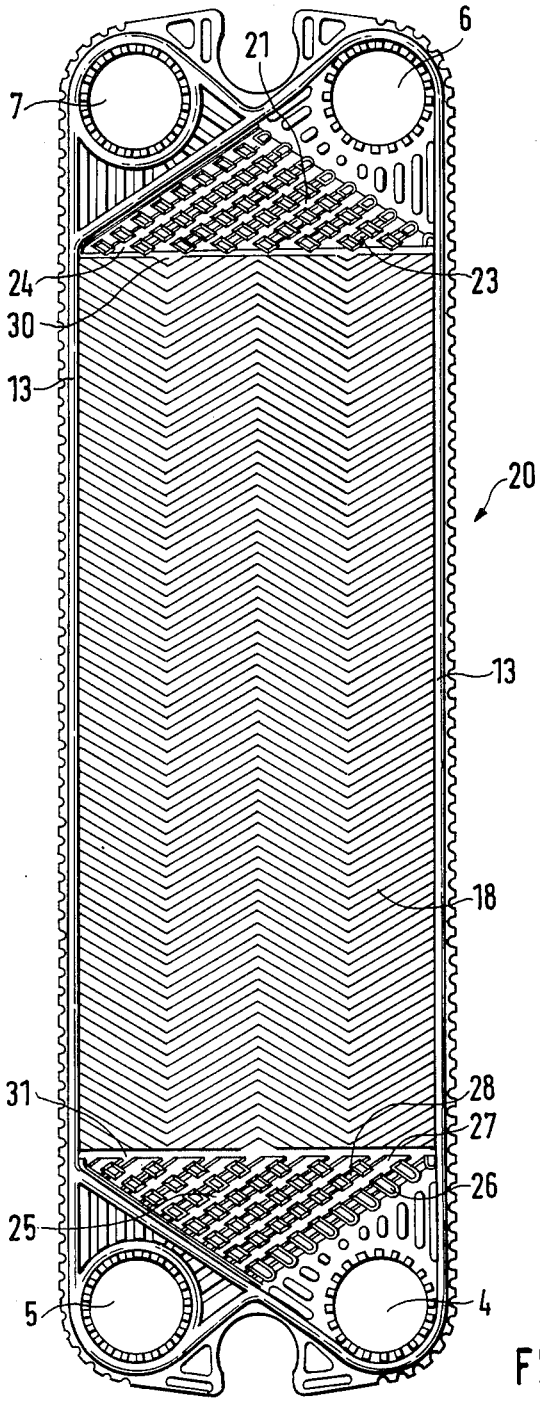
FIG. 4 shows a plan view of a first embodiment of the heat exchanger plate according to the invention.
Figure 5:
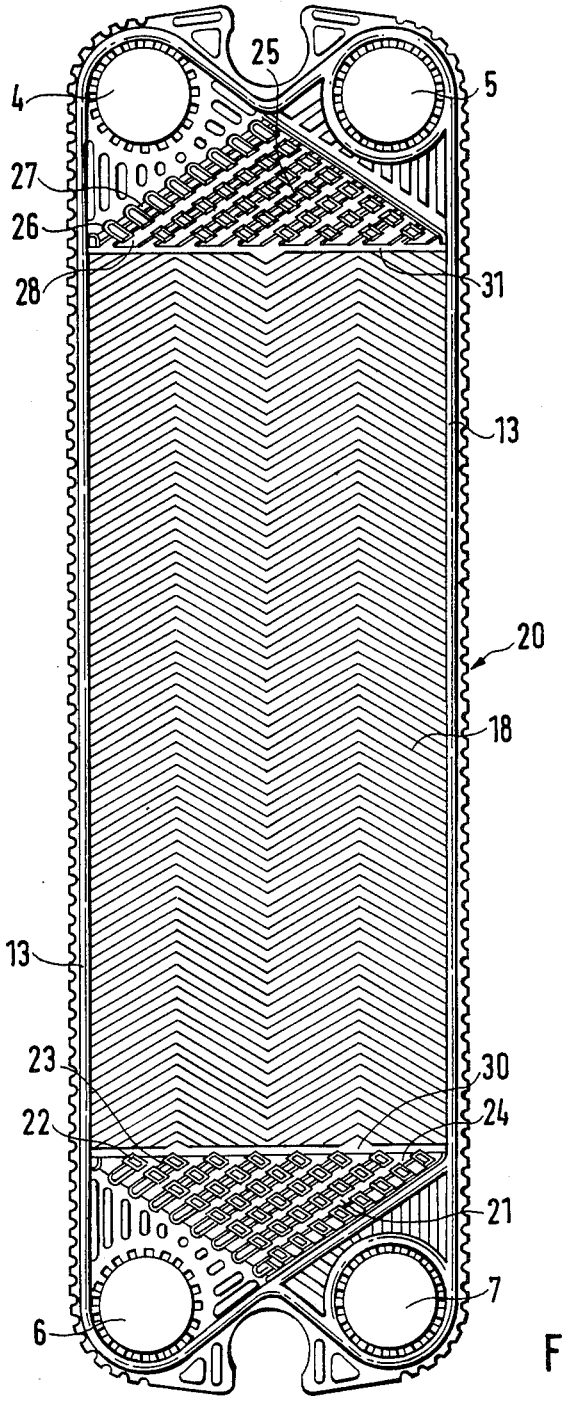
FIG. 5 shows a plan view of the heat exchanger plate of FIG. 4 rotated by 180° relative to one another.

FIGS. 4–7 now show a first embodiment of the novel heat exchanger plate 20, which in turn is shown in one position in FIG. 4 and in a position rotated by 180° with respect thereto in FIG. 5. In its embodiment, the plate 20 is largely similar to the plate 3, and so the reference numerals used earlier for features described above are used below as well.

Figure 7:
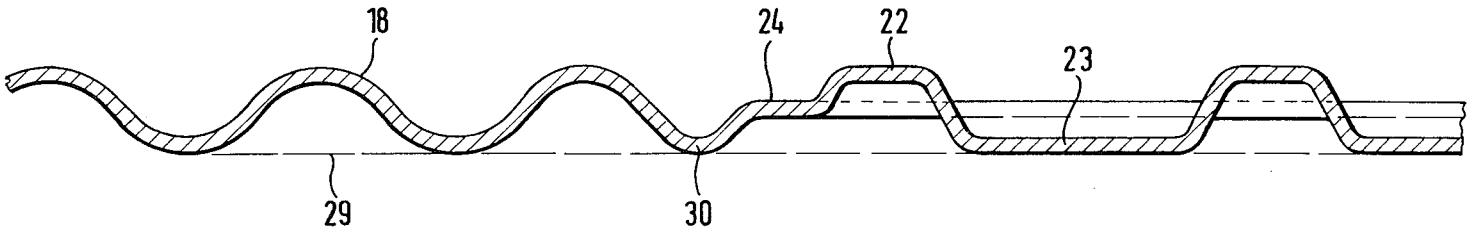
FIG. 7 is a sectional view taken along the line VII—VII of FIG. 6.

Unlike the prior art, however, in the novel plate one of the triangular zones 21, in the present case the zone communicating with the opening 6, is embodied such that the profile, originating in ray-like fashion at the opening, comprises flow sections 22, 23 adjoining one another and having alternating and oppositely-disposed profile directions. In the present case, beginning at the plane 24, the sections 22 are embossed into peaks toward the observer, while the sections 23 are embossed into valleys away from the observer creating a waffle-like grid structure. The point of departure here is that beginning at the plane of the base material from which the plate is embossed, that is, the plane represented by the plane of the drawing, the plane 24 is raised by half the total depth of the plate embossing, or in other words in the present case is staggered toward the observer. Thus, the plane 24 runs through an axis of the profile longitudinally bisecting the upper and lower pitch extremes of the profile, as best shown in FIG. 7.

As for the second triangular zone 25, which adjoins the opening 4, this zone has, along the overlap by the lines, rotated by 180°, of sections 22, 23 of the first triangular zone 21, a profile having sections 26, 27, which correspond to those of the first triangular zone 21 but have an opposite embossing direction; the spacings 28 of this profile likewise, by raising of the base material, form intermediate plateaus at the level of half the total depth of the plate embossing. That is, if the plate shown in FIG. 5 is placed on the plate of FIG. 4, then valley sections 27 of the triangular zone 25 are at the top, resting on peak sections 22 of the triangular zone 21, and at the bottom, valley sections 23 come to rest on peak sections 26. On the other hand, the flow channels disposed in a row-like array between the various sections create passages having a spacing equivalent to twice the total embossing depth of the plates. Finally, the spacing between the faces 24 and 28 disposed medially between adjacent flow channels is equal to the total embossing depth of each plate.

In this manner, ray-like flow channels extend from the openings 4 and 6 to the rectangular heat exchange zone 18, communicating with one another normal to the direction of the rays, with cross-flows through and between adjoining rays by means of channel segments having the same depth as the total embossing depth of the plate embossing, so that across the total triangular zones an optimal distribution of the respective flow medium can take place, while on the other hand the flow resistance of the triangular zones is greatly reduced. Because of the good media distribution, the triangular zones, like the rectangular zones 18, can participate virtually completely in the heat exchange between the two media.

Figure 6:
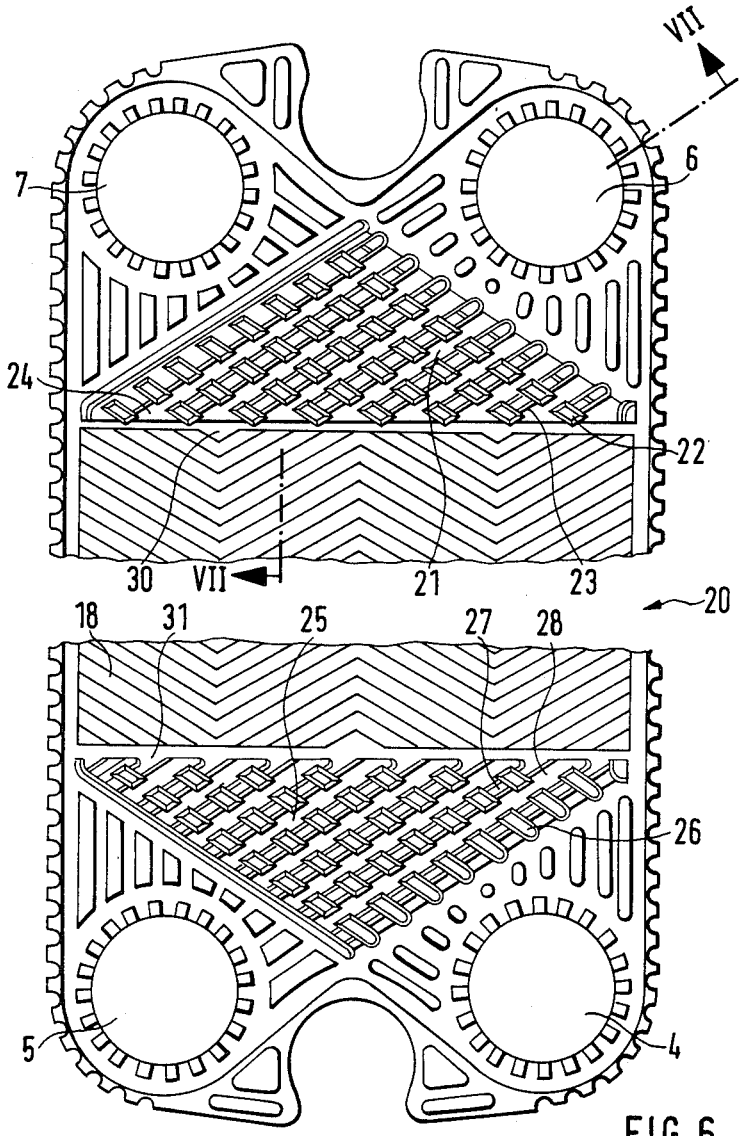
FIG. 6 shows the two triangular zones of the plate of FIG. 4, on a larger scale.

The upper and lower triangular zone of the plate 20 shown in FIG. 4 is shown on a larger scale in FIG. 6, leaving out the peripheral gasket for the sake of simplicity; FIG. 6 can be understood by referring again to the above description of FIG. 4 in particular FIG. 7 shows a sectional view approximately along the line VII—VII of FIG. 6. Here, the line 29 represents the starting plane, from which the plate material is provided with an outwardly extending profile by embossing deformation. The corrugations of the rectangular zone 18 represent the total depth of the embossing, while at reference numeral 24 an intermediate plateau of the base material is shown to be formed at one-half the total embossing depth, from which intermediate plateau level the peak sections 22 and valley sections 23 in the triangular zones are formed out in opposite directions, in each case by half the total embossing depth.

As shown in FIGS. 4–6, the sections 22, 23 and 26, 27 of the profile have a substantially rectangular apical face, and adjoining sections are rotated relative to one another by an angle on the order of 66°, in the present case, with respect to the larger cross section of the apical face, in such a manner that apical faces resting on one another of adjoining plates are likewise rotated by this angle relative to one another. As a result, the profiles of adjoining plates are reliably precluded from slipping into one another in response to mutual lateral displacement, under the pressure of the force with which the plates are fastened into a stack.

It is also apparent from FIGS. 4–6 that between each triangular zones 21 and 25 on the one hand and the rectangular zone 18 on the other, there is a flat transitional zone 30, 31, extending the entire width of the plate and having been left unchanged, that is, without deformation of the original material of the plates. This transitional zone acts as a tie bar crosswise to the longitudinal direction of the plates and guarantees the shape stability of the plates.

Figure 8:
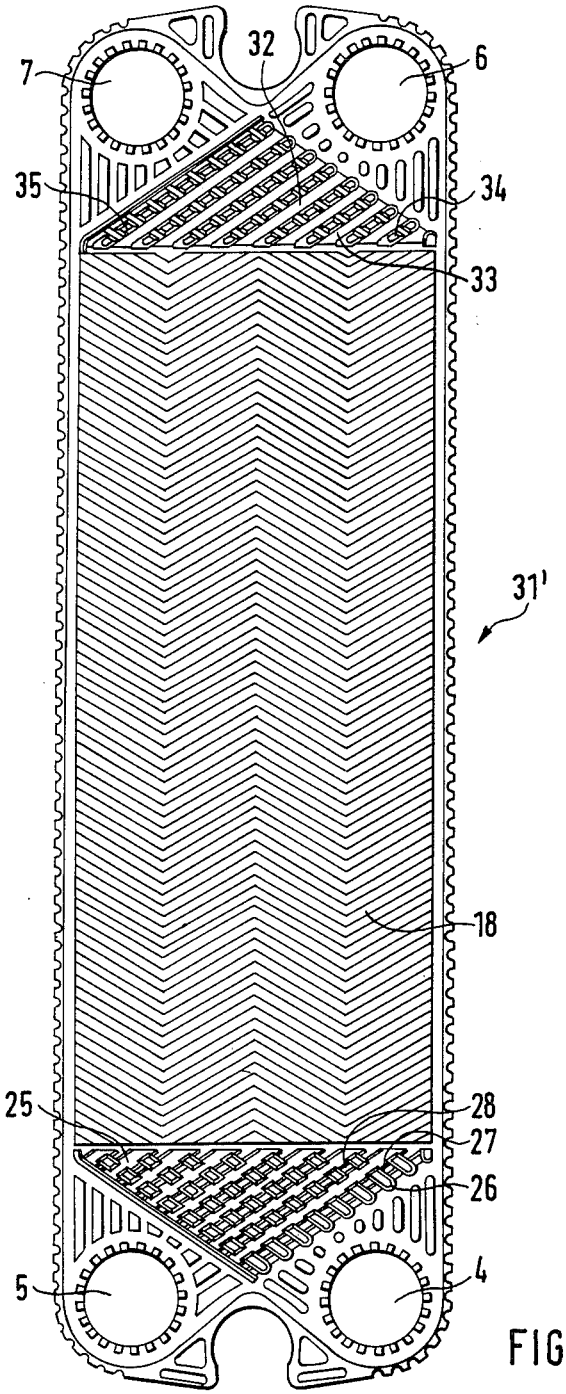
FIG. 8 is a sectional view similar to FIG. 7 showing a modification of the plate of FIG. 4.

FIG. 8 shows a plate 31 with the peripheral gasket left out; this plate 31 is largely similar to the plate 20 of FIG. 4, and so the numerals used in FIG. 4 continue to apply here and are not described again.

Differing from FIG. 4, the upper triangular zone 32, having the sections 34 that are embossed toward the observer, that is, upward into peaks, beginning at the level of the raised plateau 33 of the base material, and the sections 35 that are embossed away from the observer, that is, downward into valleys, are dimensioned such that the peak sections 34, disposed in the longitudinal direction of the rays formed by adjoining sections, do not protrude laterally beyond the sections 35.

FIGS. 9–12, finally, with the peripheral gasket left out, show the plates 36–39, having respective rectangular middle zone 40–43 embodied in terms of embossing in a manner equivalent to the triangular zones described above in conjunction with FIGS. 4–8.

Figure 9:
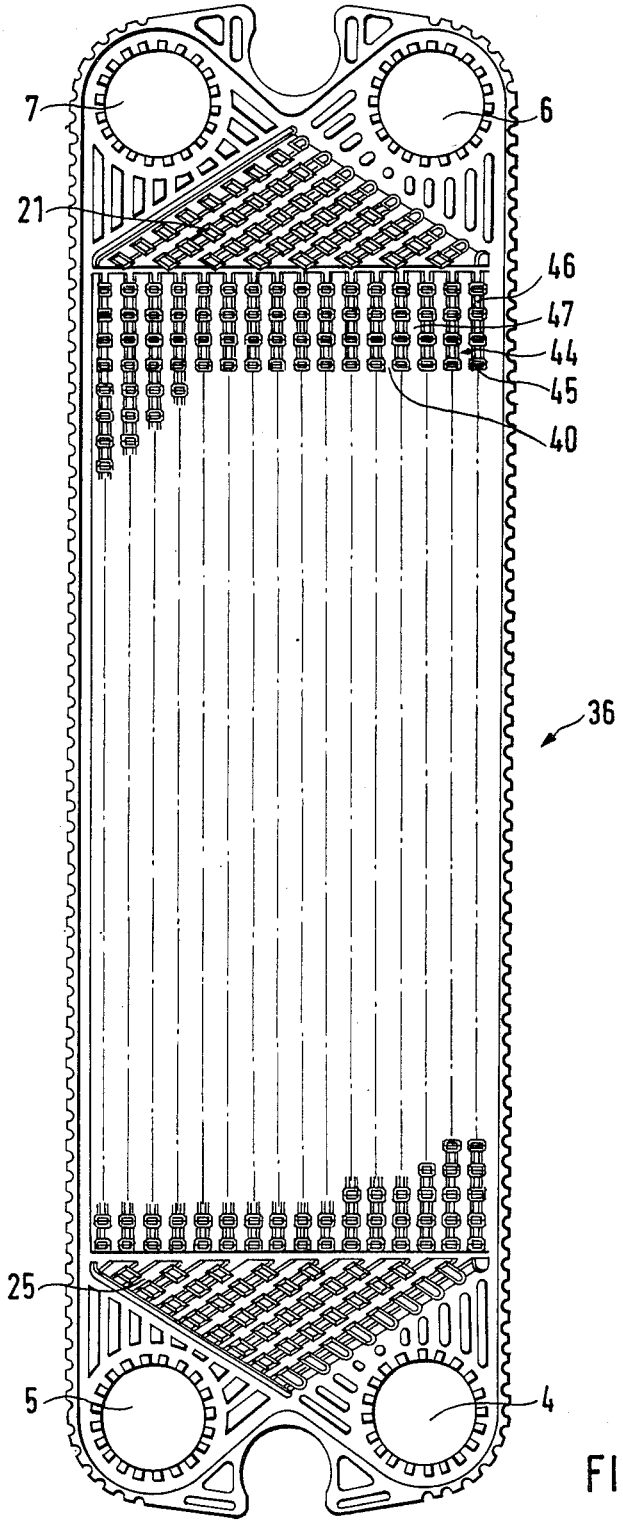
FIG. 9 shows a second embodiment of the plate of FIG. 4 in which the rectangular, middle heat exchange zone has been modified.

To this end, the middle zone 40 of FIG. 9 has disposed, parallel to the flow direction of the media, a profile formed at one-half the total embossing depth comprising rows 44 of adjoining peak and valley sections 45 and 46, respectively, the rows have a common spacing 47 crosswise of the longitudinal extent thereof, and by raising the base plate material the spacings form plateaus at the level of half the total depth of the plate embossing, as already described in detail above for the triangular zones. It is also provided that the peak and valley sections 45, 46 of opposite embossing are disposed in alternation relative to one another over the longitudinal extent of the rows 44 in such a way that sections of one embossing direction of one plate meet sections of the opposite embossing direction of the adjoing plate that is rotated by 180° when the stack of plates is arranged. In this opposed plate orrientation, flow channels are again produced in the longitudinal direction of the rows 44, these flow channels communicate with one another normal to the longitudinal extent of the flow channels by means of short channel segments. Plates having this kind of embossing in the middle zone appear to be particularly well suited for heat exchange with media laden with solids, and it is also possible for both media to have entrained solids, because all the interstices formed between such plates are identically embodied and equally well suited to facilitate that flow of medium.

Figure 10:
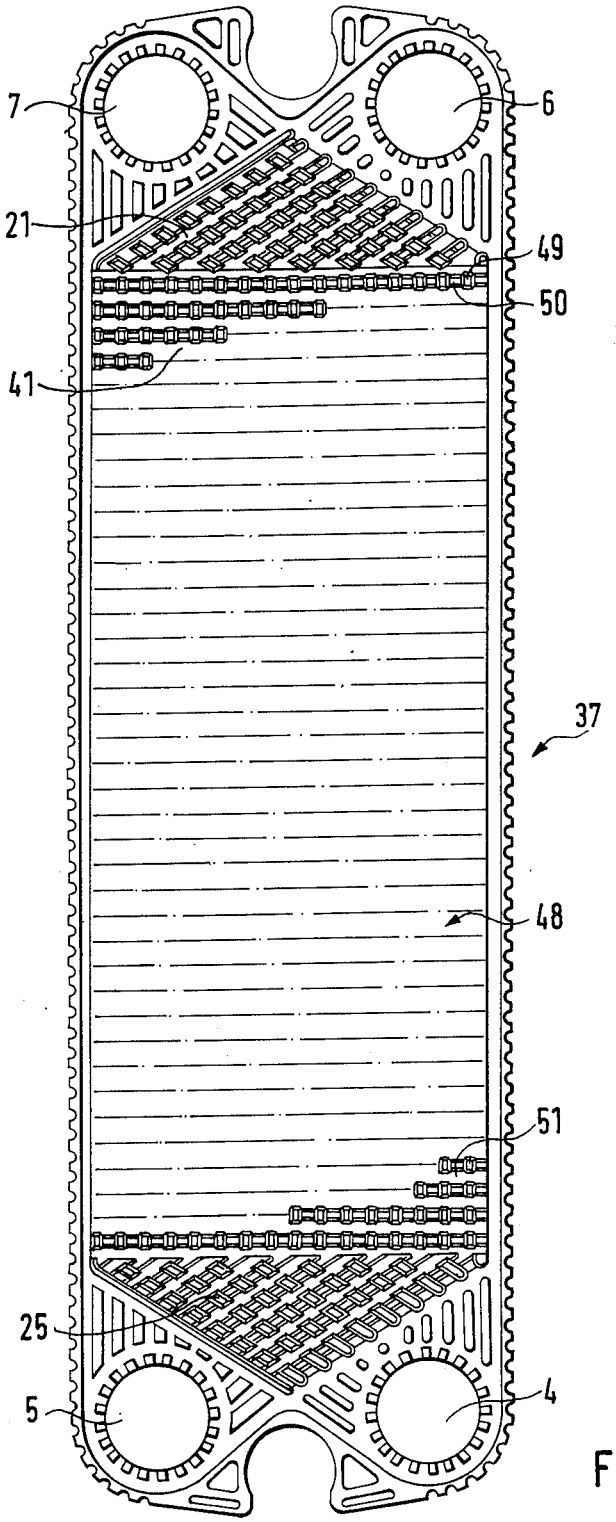
FIG. 10 shows a third embodiment of the plate of FIG. 4 in which the rectangular, middle heat exchange zone has been modified.

The plates of the type shown in FIG. 10 differ from those of FIG. 9 in that here the rows 48 are oriented laterally beside one another, crosswise to the flow direction, but once again they have a profile formed by adjoining peak and valley sections 49, 50 of opposite embossing direction and having one-half the embossing depth, beginning at the base material of the plates. Normal to the longitudinal extent thereof, the rows 48 have a common mutual spacing 51, and the spacings are disposed on strips which, by raising the base material, form plateaus at the level of half the total depth of the plate embossing. Naturally, once again the sections 49 and 50 of the two embossing directions are staggered relative to one another in such a manner that peak sections of one embossing direction of one plate meet valley sections of the opposite embossing direction of the adjoining plates, rotated by 180° relative to the first, in the formation of the stack of plates.

Figure 11:
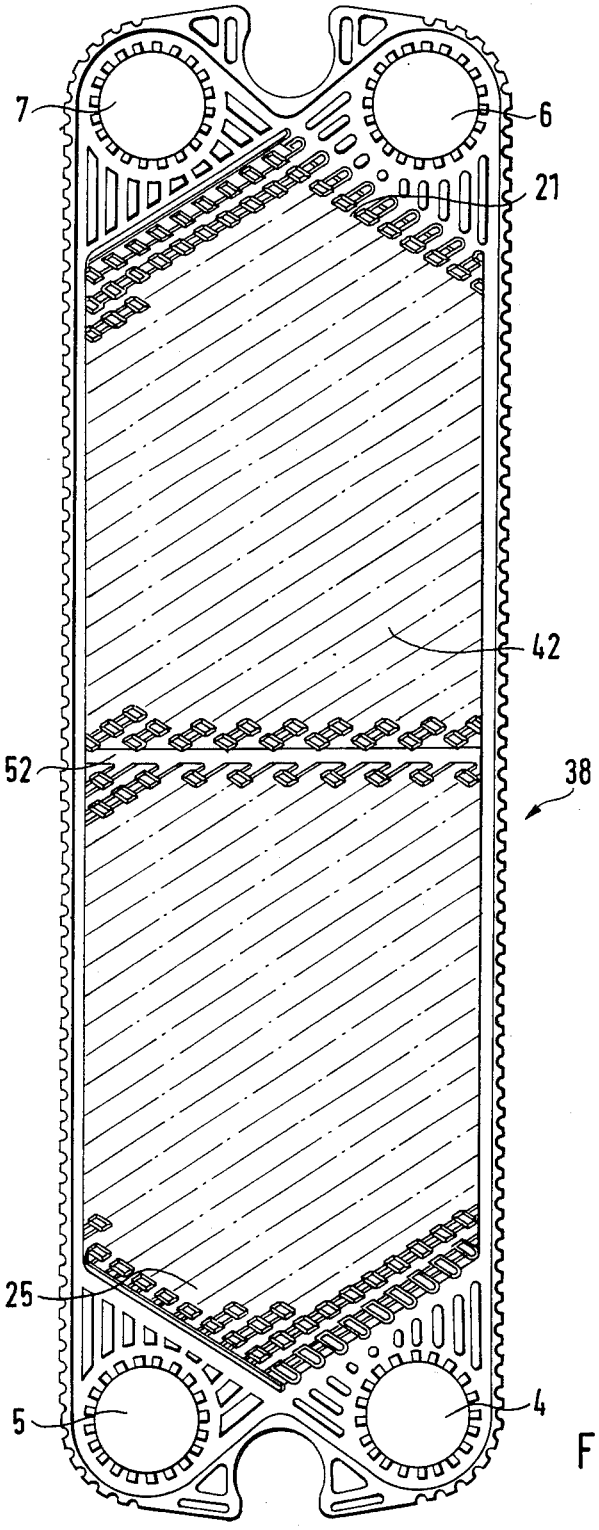
FIG. 11 shows a fourth embodiment of the plate of FIG. 4 in which the rectangular, middle heat exchange zone has been modified.

In the plate 38 shown in FIG. 11, differing from the plate shown in FIG. 4, half the rectangular middle zone, in terms of its embossing, in each case forms a continuation of the embossing of the triangular zones 21 or 25 disposed near the plate ends; these two kinds of profile are separated from one another in the middle of the plate by a transition zone 52 that is left undeformed and extends normal to the flow direction of the media.

Figure 12:
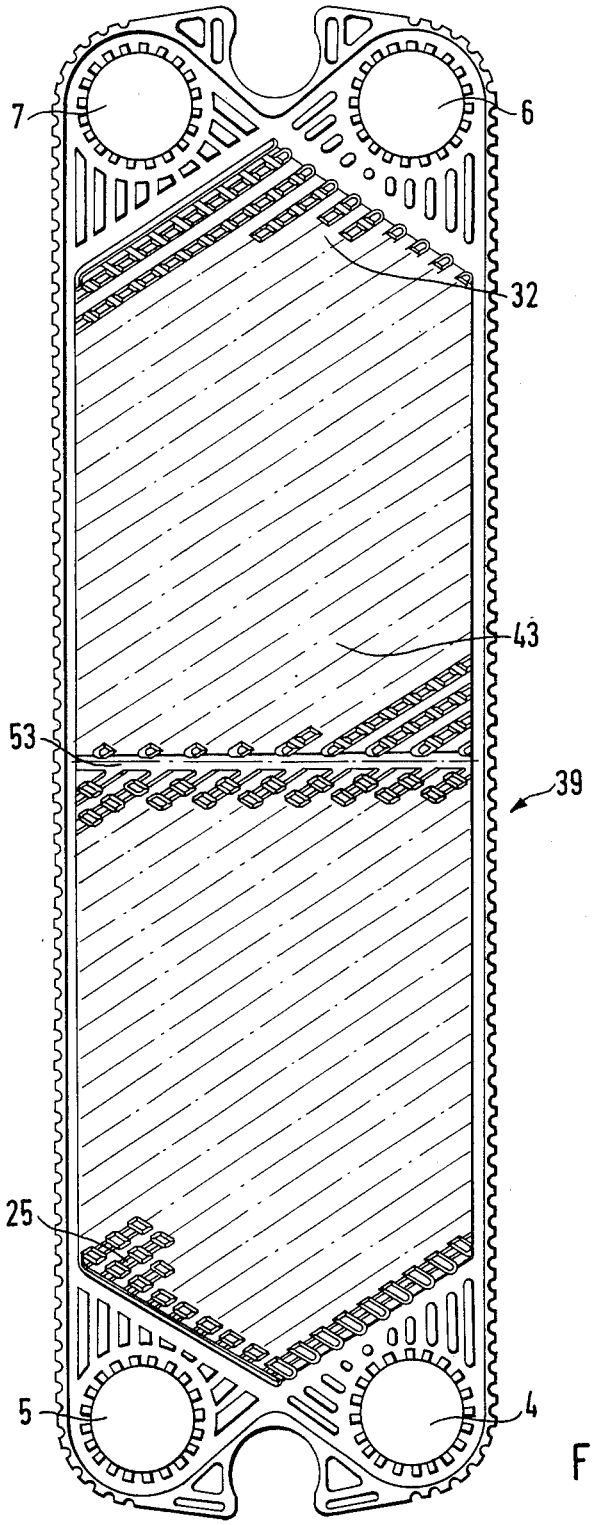
FIG. 12 shows a fifth embodiment of the plate of FIG. 4 in which the rectangular, middle heat exchange zone has been modified.

Finally, the plate 39 of FIG. 12, beginning with the plate shown in FIG. 8, is produced by providing that the profile of the triangular zones 32 or 25 of FIG. 8, viewed in the flow direction, have been continued over half the length of the plate, and once again the two kinds of profile are separated from one another by an undeformed transition zone 53.

The description of the triangular sections in conjunction with FIGS. 4–8, with respect to the mutual bracing of adjoining plates that are rotated by 180° relative to one another, is equally applicable to the plates of FIGS. 11 and 12.

In the plates of FIGS. 4–12, the flow conditions are in each case described, and shown in part, such that the medium moves between openings located on one side of the vertical center line of the plates. The novel profile, however, equally permits a movement of the media between openings diagonally opposite one another; all that is required is a suitably modified embodiment of the peripheral gasket.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A heat exchanger, comprising substantially rectangular plates in alignment with one another and provided by embossing with a bead-like profile of uniform total depth, said plates being alternatingly rotated by 180° relative to one another and having a peripheral gasket disposed therebetween and further being fastened detachably into a stack with the facing profiles of adjacent plates resting on one another in opposed relation, wherein the plates alternatingly form flow spaces, encompassed by the peripheral gasket, for a first medium and a second medium guided substantially parallel to the first, the flow spaces being supplied with the respective medium via inlet and outlet openings in alignment with one another and formed by means defining openings disposed in the corner regions of the plates, the plates further having a middle rectangular heat exchange zone and two triangular heat exchange zones adjoining the middle zone on opposite sides, said triangular zones transfer the flow section of the middle zone to the vicinity of the inlet and outlet opening, to which end the profile of the triangular zones is embodied substantially as rays originating at the opening and having a pitch defining a mutual spacing, characterized in that said rays of one triangular zone (21, 32) comprise a profile having regular sections (22, 23; 34, 35) having the pitch of the ray spacing and adjoining one another in the direction of the rays and embossed alternatingly in opposite directions out of the plane of a plate, with the embossing depth originating at the plane of the plate (20, 31, 36–39), and further that the rays of the other triangular zone (25), along where they are covered by the rays, rotated by 180°, of the first triangular zone, have a profile having sections (26, 27) corresponding to that of the first triangular zone but embossed in the opposite direction.

2. A heat exchanger as defined by claim 1, further wherein a surface of the plate is embossed such that the profile undulates to produce a sinusoidal cross section.

3. A heat exchanger as defined by claim 1, further wherein a surface of the plate is embossed such that the profile undulates to produce a substantially rectangular apical face.

4. A heat exchanger as defined by claim 1, further wherein face portions of said assembled, opposed plates coming in contact form an angle with one another with respect to orientation of a largest cross section of said face portions.

5. A heat exchanger as defined by claim 2, further wherein face portions of said assembled, opposed plates coming in contact form an angle with one another with respect to orientation of a largest cross section of said face portions.

6. A heat exchanger as defined by claim 3, further wherein face portions of said assembled, opposed plates coming in contact form an angle with one another with respect to orientation of a largest cross section of said face portions.

7. A heat exchanger as defined by claim 4, further wherein the angle of contact between said face portions is on the order of 90°.

8. A heat exchanger as defined by claim 5, further wherein the angle of contact between said face portions is on the order of 90°.

9. A heat exchanger as defined by claim 6, further wherein the angle of contact between said face portions is on the order of 90°.

10. A heat exchanger as defined by claim 1, further wherein the plates have a flat transitional zone disposed between each triangulated zone and the middle, rectangular zone, which transitional zone extends over an entire width of the plate and is left unembossed.

11. A heat exchanger as defined by claim 1, further wherein the middle, rectangular zone of the plate has a central plane disposed longitudinally thereof and a profile comprised of alternating rows of peaks and valleys, the rows further having a common lateral spacing elevated from said central plane, said peaks and valleys being staggered with respect to one another over a longitudinal extend of the rows such that peaks of one plate contact valleys of an adjoining plate, the latter being rotated by 180°, when a stack of plates is formed.

12. A heat exchange as defined by claim 1, further wherein the middle, rectangular zone of the plate has, disposed normally thereof, a profile comprised of rows of peaks and valleys which extend alternately out of a central plane, said rows further having a common lateral spacing elevated from said central plane to form a portion of a plateau at a level of half the total depth of the plate embossing, and wherein the peaks and valleys are staggered with respect to one another over a longitudinal extent of the rows such that peaks of one plate contact valleys of an adjoining plate, the latter being rotated by 180°, when a stack of plates is formed.

13. A heat exchanger as defined by claim 1, further wherein the middle, rectangular zone of the plate is divided into two halves adjoining the respective triangulated zone each half having a profile complemental to the profile of the adjoining triangulated zone, and between the halves a transitional zone extending laterally over an entire width of the plates is provided that is left unembossed.

* * * * *